US005359986A

United States Patent [19]

Magrath, III et al.

[11] Patent Number: 5,359,986

[45] Date of Patent: Nov. 1, 1994

[54] PITCHING SYSTEM AND METHOD

[75] Inventors: Earl K. Magrath, III; Earl K. Magrath, Jr.; W. Edward London, all of Chattanooga, Tenn.

[73] Assignee: Golf Players Inc., Chattanooga, Tenn.

[21] Appl. No.: 107,650

[22] Filed: Aug. 18, 1993

[51] Int. Cl.[5] ..... A63B 69/40

[52] U.S. Cl. ..... 124/78; 124/1; 124/6

[58] Field of Search ..... 124/1, 6, 16, 78

[56] References Cited

U.S. PATENT DOCUMENTS

| | | | |
|---|---|---|---|
| Re. 28,462 | 7/1975 | Halstead | 124/1 |
| 3,659,576 | 5/1972 | Eade et al. | 124/7 |
| 3,724,437 | 4/1973 | Halstead | 124/78 |
| 3,777,732 | 12/1973 | Holloway et al. | 124/78 |
| 3,785,358 | 1/1974 | D'Angelo et al. | 124/1 |
| 3,811,421 | 5/1974 | Betten | 124/1 |
| 3,913,552 | 10/1975 | Yarur et al. | 124/1 |
| 4,195,614 | 4/1980 | Ponza | 124/1 |
| 4,197,827 | 4/1980 | Smith | 124/78 |
| 4,299,383 | 11/1981 | Yuasa | 273/29 A |
| 4,352,348 | 10/1982 | Griffith | 124/78 |
| 4,423,717 | 1/1984 | Kahelin | 124/78 |
| 4,531,504 | 7/1985 | Gilreath | 124/78 |
| 4,655,190 | 4/1987 | Harris | 124/78 |
| 4,712,534 | 12/1987 | Nozato | 124/78 |
| 4,834,060 | 5/1989 | Greene | 124/78 |
| 5,107,820 | 4/1992 | Salansky | 124/78 |
| 5,125,653 | 6/1992 | Kovacs et al. | 124/78 X |
| 5,178,123 | 1/1993 | I-Chih | 124/78 |

FOREIGN PATENT DOCUMENTS

| | | | |
|---|---|---|---|
| 2220290 | 10/1974 | France | 124/6 |
| 4021282 | 10/1991 | Germany | 124/6 |

OTHER PUBLICATIONS

JUGS 1989 Catalog, 28 pages.
The CASEY Brochure, pp. 6 and 7.
The TRU-PITCH Brochure, 2 pages.
ATEC Automatic Retrieval Systems, 6 pages.
The JUGS Story, 4 pages.
PACER, Pitching Machines for Commercial Batting Ranges, 4 pages.

*Primary Examiner*—Randolph A. Reese
*Assistant Examiner*—John A. Ricci

[57] ABSTRACT

A pitching system will pitch either softballs or baseballs to a single station. At least one of the pitching machines in the system can have variable speed pitches. As the speed of the pitches changes, the angles at which the balls are thrown will be varied. In that manner, the strike zone at the batting station can be maintained. The pitching system includes a pitching machine with rotatable upper and lower wheels. Balls are fed to and thrown from these wheels. The speed at which the balls are thrown by the wheels can be adjusted. When the speed is adjusted, a control will actuate a tilting device for adjusting the angle at which the balls are thrown. This angle is decreased as the speed of the thrown balls is increased.

23 Claims, 2 Drawing Sheets

PITCHING SYSTEM AND METHOD

BACKGROUND OF THE INVENTION

1. Field of the Invention

The instant invention relates to a system and method for pitching a ball. At least one pitching machine can be provided in the system. This pitching machine has rotatable wheels which will sequentially receive and throw balls. The speed at which the balls are thrown can be adjusted. When the speed is adjusted, a control means will change the angle at which the balls are thrown. Therefore, as the speed at which the balls are thrown is increased, the angle at which the balls are thrown is decreased.

2. Description of the Background Art

Various pitching devices are known. For example, dual wheel systems which will throw baseballs or softballs are known. In such systems, a batting station is normally designated for one speed of balls. This therefore limits the number of players which can utilize that station. If the speed at which the balls are to be received at that station is changed, this is normally a complicated procedure which must be performed by the owner or attendant.

Also, the existing pitching machines can not automatically accommodate different heights of users. Players with different heights have strike zones at different heights. In conventional systems, balls cross the strike zone at a particular height. If this zone is to change, the height at which balls are pitched is manually changed. If this adjustment is made, there is no provision to automatically return the balls to a different strike zone after completion of a first cycle. Therefore, it may be possible to accommodate a first player but the next different sized player will not automatically be accommodated.

SUMMARY OF THE INVENTION

Accordingly, a primary object of the invention is to provide a pitching system and method which can throw either softballs or baseballs to a single station.

It is a further object of the instant invention to throw these balls to a single station at varying speeds. When the speed for throwing the balls is changed, it is then necessary to change the angle at which the balls are thrown to ensure that the balls cross the strike zone. For example, a 40 mile per hour pitch should be thrown at an angle of approximately 30° while a 70 mph pitch should be thrown at an angle of only 4° to 5°. These angles need to be changed to ensure that the ball will cross a designated strike zone.

By providing more than a single ball speed for a station, the number of players which can utilize that station is increased. Moreover, the adjustment in angle at which the ball is thrown needs to be automatically carried out.

In the pitching station, balls are thrown for a given cycle. It is an object of the instant invention to enable the height of the strike zone to be adjusted by the users. Therefore, seven foot tall or four foot tall players can be accommodated in the same station.

It is a further object of the instant invention to automatically return the angle at which the balls are thrown to a home position after a cycle is completed. Therefore, a subsequent user can then adjust the pitched balls to their desired height.

It is a further object of the instant invention to provide a safe pitching system and method. In such a system, pitch delays should be provided between adjustments to pitch height in order to avoid errant thrown balls. It is a further object to limit the range of the speeds at which a ball can be pitched within a particular station. Therefore, smaller children can be excluded from a station having pitches which are too fast. This will prevent a child from inadvertently selecting a pitch having to great a speed after they have entered the station.

A further object of the instant invention is to provide a pitching system and method which will enable the player to anticipate the pitches. The players's concentration, swing consistency and timing can therefore be improved.

Yet another object of the instant invention is to provide a pitching system and method which can be customized to the location in which it is used. Because the area for batting distance varies and because the height of the pitching machine can vary, it is important to make such a highly flexible system and method.

A further object of the instant invention is to provide a pitching system and method which is easy to maintain and which is relatively inexpensive.

These and other objects of the invention are fulfilled by a pitching system which comprises a pitching machine having upper and lower wheels. Balls are sequentially fed to and thrown from the wheels. The balls will be thrown at a selected angle. The speed at which the balls are thrown is chosen by the player. When the speed is changed, the angle at which the balls are thrown is adjusted by a tilting means. A control means will automatically coordinate the speed of the balls with the angle at which they are thrown.

These and other objects of the instant invention are also fulfilled by a method for pitching a ball comprising the steps of providing a pitching machine with two rotatable wheels. These wheels are rotated in opposite directions to throw balls. The speed at which balls are thrown from the wheels is selected by an operator. When this speed is changed, the angle at which the balls are thrown is also changed. This angle will be based on the speed at which the balls are thrown.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
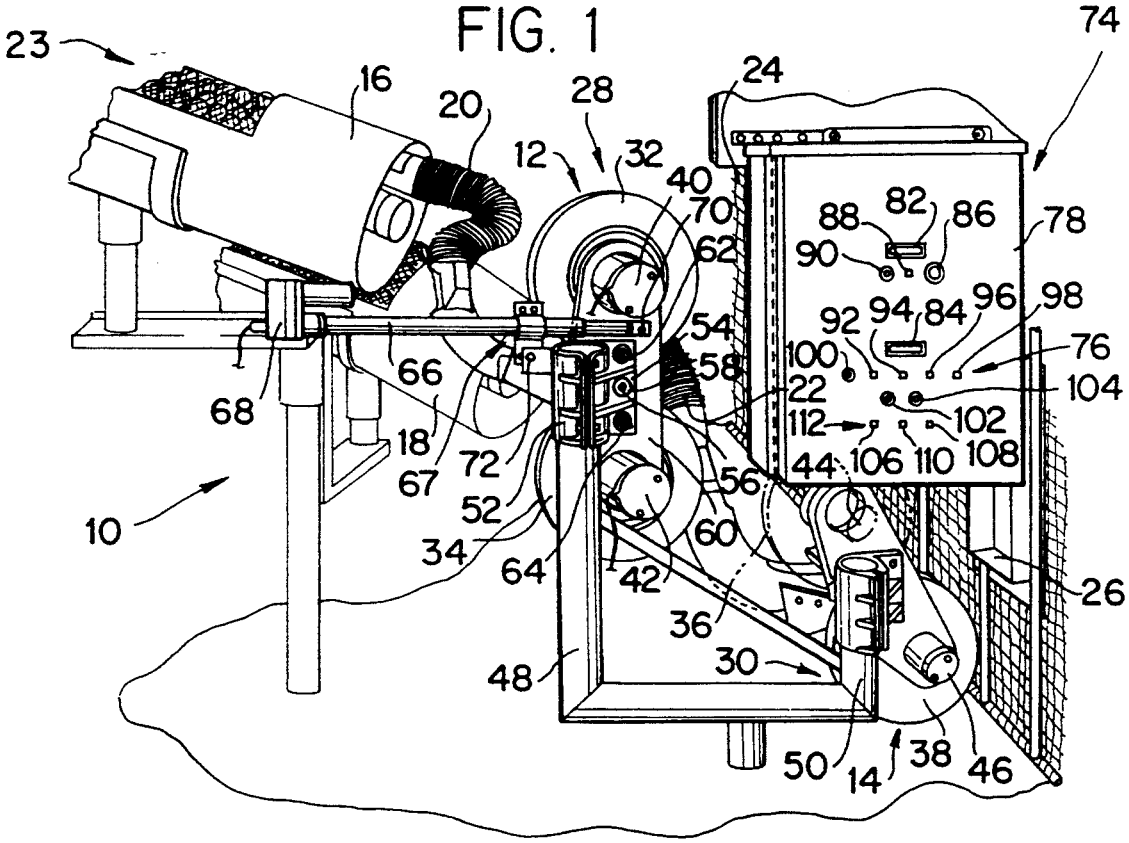
FIG. 1 shows a left-hand side view of the pitching system of the instant invention.
Figure 2:
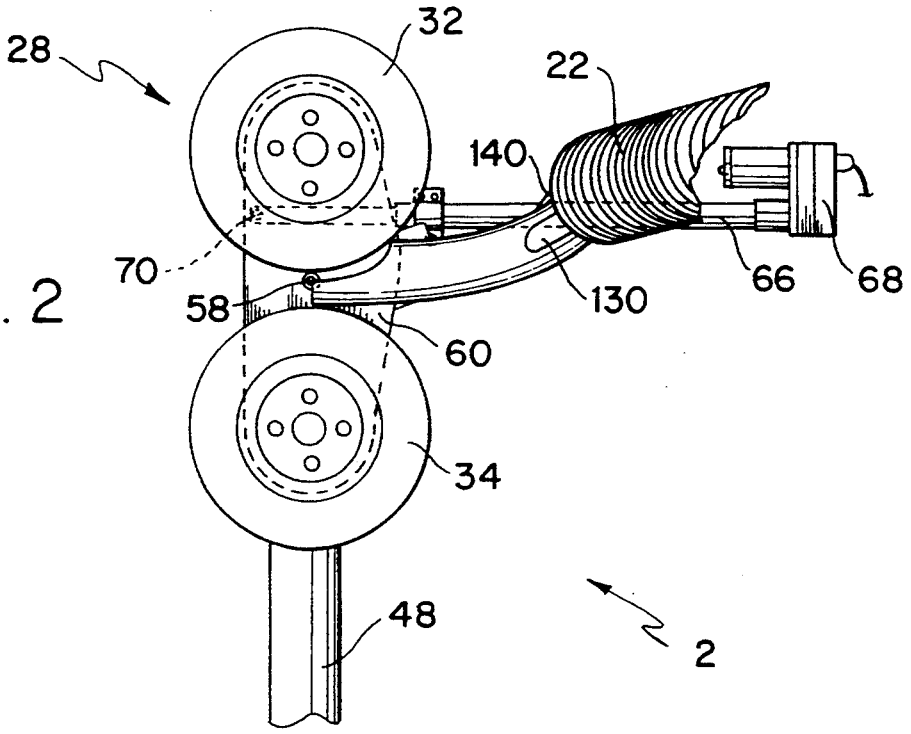
FIG. 2 shows a right-hand side view of the pitching system of the instant invention.

Referring in detail to the drawings and with particular reference to FIG. 1, a pitching system 10 of the instant invention is shown. This pitching system 10 includes a baseball pitching machine 12 and a softball pitching machine 14. In FIG. 1, the baseball pitching machine 12 is shown above the softball pitching machine 14. It should be readily appreciated that the positioning of these machines can be switched. Alternatively, the machines can be in a side by side arrangement. It is simply necessary for the netting 24 which protects these pitching machines to have an appropriately sized and positioned opening 26 to accommodate balls thrown from either pitching machine.

Connected to the baseball pitching machine 12 is a baseball hopper 16. This baseball hopper 16 is connected through a baseball tube 20 to the pitching machine 12. Similarly, the softball pitching machine 14 is connected to a softball hopper 18 through a softball tube 22. Each tube 20, 22 is connected to a respective machine 12, 14 by a rigid hand. These hands will ensure that balls are properly fed to the wheels. Means are provided in the instant invention for automatically feeding baseballs and softballs, respectively to the baseball hopper 16 and softball hopper 18. The baseball hopper 16 and softball hopper 18 with the tubes 20 and 22 act as a means 23 for sequentially feeding balls. While two separate hoppers 16 and 18 have been shown, any suitable arrangement can be employed for feeding balls to the pitching machines 12, 14.

Each pitching machine 12 and 14 has a set of wheels associated therewith. A first set of wheels 28 is provided on the baseball pitching machine 12 while a second set of wheels 30 is provided on the softball pitching machine 14. The first set of wheels 28 includes an upper wheel 32 and a lower wheel 34. Similarly, the second set 30 of wheels includes an upper wheel 36 and a lower wheel 38. These wheels are operated by motors 40, 42, 44 and 46 as indicated in FIG. 1. While four motors are shown for each wheel, it should be appreciated that a single motor or any other combination of motors can be used. For example, if a single motor is used, the wheels 32, 34, 36 and 38 can be linked to this motor through a suitable transmission.

The wheels of each set 28, 30 are designed to rotate in an opposite direction. For example, the upper wheel 32 will rotate in a counter-clockwise direction while the lower wheel 34 rotates in a clock-wise direction as viewed in FIG. 1. In this manner, balls fed through tube 20 to the first set of wheels 28 will be thrown therefrom. Likewise, each wheel of the second set of wheels 30 will rotate in opposite directions.

Each pitching machine 12 and 14 is mounted on a post 48, 50, respectively. While two posts are shown, it should also be appreciated that these pitching machines can be mounted on the same posts. Any suitable arrangement for holding the pitching machines in position can be carried out. At the top of post 48 is a collar 52. This collar 52 has a flange 54 extending from one side thereof. In the flange 54, a hole is provided through which a mounting pin 56 is placed. This mounting pin 56 will pivotably hold the pitching machine 12 on the collar 52. This pin 56 can be a shaft with a bearing or bushing mount.

The motors 40, 42 and wheels 32, 34 of the pitching machine 12 are mounted on casing 60. The mounting pin 56 extends through casing 16. The casing 16 and collar 52 are mounted together through the mounting pin 56. The casing 16 and the motors and wheels mounted thereon are pivotable about pivot axis 58. Locking pins 62 and 64 are provided respectively above and below the mounting pin 56. When these locking pins 62 and 64 are in the released position, the casing 60 is free to pivot about pivot axis 58. However, when these locking pins 62, 64 are closed, the position of the casing 60 and its pitching machine 12 is fixed. These locking pins 62, 64 can be omitted if so desired.

In order to pivot the casing 60 and pitching machine 12 about the pivot axis 58, a linear actuator 66 is provided. This linear actuator 66 has a motor 68 at one end thereof. In this example, the linear actuator is a worm drive, but a rack and pinion drive, belt and pulley drive or any other suitable arrangement can be used for adjusting the positioning of the casing 60 and pitching machine 12. The linear actuator 66 can be pneumatically driven, hydraulically driven, electronically driven or driven by any other suitable arrangement.

At the forward end of the linear actuator 66 is a first connection 70 for attaching one end of the linear actuator 66 to the casing 60. About a third of the way from this first connection 70, a second connection 72 is provided. At the second connection 72, the linear actuator 66 is mounted to the collar 52. As the worm gear in the linear actuator 66 moves forwardly or rearwardly, the second connection 72 will be fixed while the first connection 71 will move. In other words, the distances between the first and second connections 70 and 72 will vary with movement of the linear actuator. This movement results in the casing 60 pivoting about the pivot axis 58. Such pivotal movement will move the pitching machine 12, the first set of wheels 28, and the motors 40 and 42 to change the angle at which balls are thrown from pitching machine 12. The linear actuator 66 and pivotable connections therefore act as a tilting means 67. A Teflon TM or other coating to prevent sticking can be provided between casing 60 and flange 54.

Due to the flexibility of tube 20, pivoting movement of the pitching machine 12 can be accommodated. The rigid hand at the end of tube 20, will ensure that balls are properly fed to the first set of wheels 28 regardless of the inclination of the pitching machine 12. While the figures only show a linear actuator applied to the baseball pitching machine 12, it should readily be appreciated that this pivoting arrangement can be duplicated for the softball pitching machine 14. Therefore, two linear actuators and pivotable connections can be used such that both the baseball pitching machine 12 and softball pitching machine 14 are pivotably adjustable. Alternatively, only the softball pitching machine 14 can be pivoted as desired while the baseball pitching machine 12 can stay in a fixed, nonpivotable position. Any combination is possible.

This adjustment for the pitching machine 12 about the pivot axis 58 will accommodate different angles for throwing the balls from machine 12. These angles are selected based in accordance with the speed at which the balls are thrown. A control means 74 is provided with a speed control means 76 for changing the speed at which balls are thrown.

Figure 5:
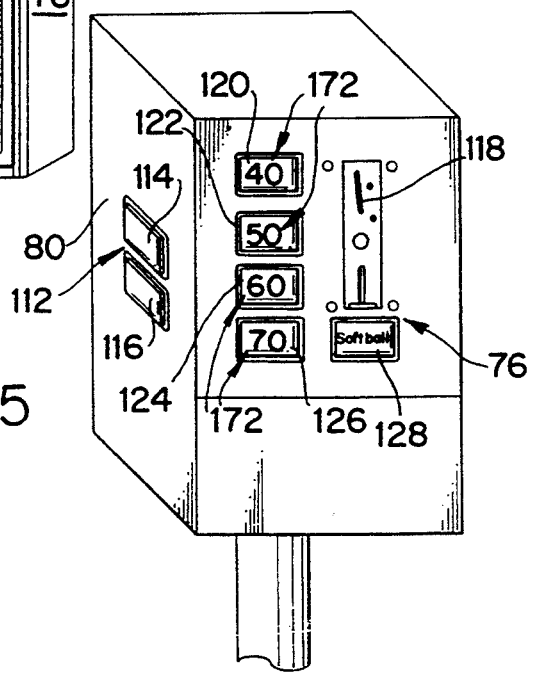
FIG. 5 is a perspective view of the coin box or second control box of the instant invention.

For now, only the speed control means 76 on the first control box 78 will be discussed. It should be noted that FIG. 5 shows a second control box 80 also having speed control means 76 which will also be described later. On the first control box 78 shown in FIG. 1, two LED displays 82, 84 are provided. The first LED 82 will display the speed at which the softballs are pitched from the softball pitching machine 14. The second LED display 84 will show the speed at which baseballs are thrown by the baseball pitching machine 12.

Beneath the first LED display 82 is a softball speed control knob 86, a softball START button 88 and an ON/OFF switch 90. When the switch 90 is in the OFF position, the softball pitching machine 14 will not be operable. When the switch is turned on, softballs can then be pitched from this machine 14. One method for pitching softballs from this machine is to actuate button 88. It is contemplated that this first control box 78 will be located proximate to the pitching machines 12 and 14. In that way, the owner or attendant for the system can perform adjustments to the pitching system 10.

Beneath the second LED display 84 are four speed selection buttons 92, 94, 96 and 98. These four buttons will determine the speed at which baseballs are thrown from the pitching machine 12. While any number of buttons can be used, only four buttons are used in the present invention. Therefore, there is only a range of four different speeds at which baseballs can be thrown. For example, the baseballs may be thrown at 40 mph, 50 mph, 60 mph or 70 mph depending on whether switch 92, 94, 96 or 98, respectively are actuated.

This wide range of speeds for throwing baseballs has a tremendous advantage. The batting station will no longer be limited to a single speed such that the number of players which can utilize a station is greatly increased. As a safety feature, only four speeds are provided. Therefore, small children can be eliminated from stations which have too great a speed. If a wide range of speeds were available in a single station, for example 10 mph, 40 mph, 70 mph and 100 mph, then small children could enter such a station and inadvertently select a speed which is too fast for them. In this manner, injury to children can be avoided.

It should be appreciated, that the speeds at which baseballs are thrown can be provided as any desired speed. For example, the speeds can be set anywhere from 0 to 100 mph. In the instant invention, only four sets of speeds are given for each station. As noted above, it is contemplated that the speeds will be within a selected range. For explanation purposes, these speeds are given as 40, 50, 60 and 70 mph but it should be appreciated that any number of speeds for a range and any specific speed could be used in the instant system.

The speed selection buttons 92, 94, 96 and 98 and the softball START button 88 represent the speed control means 76 at the first control box 78. The speed control means 76 also includes buttons on the second control box 80 which will be discussed in detail below.

Adjacent the speed selection buttons 92, 94, 96 and 98 is an ON/OFF switch 100. When the switch is in the OFF position, baseballs cannot be thrown from pitching machine 12. On the other hand, when this switch 100 is in the ON position and one of the four speeds is selected through switches 92, 94, 96 and 98, baseballs are thrown from pitching machine 12.

Beneath the first row of buttons 92, 94, 96 and 98 are switches 102 and 104. Switch 102 is the main power switch and switch 104 is a test switch. Switch 104 can be used by the operator at the first control box 78 in testing the system. This switch 104 will permit control of the system at either the second control box 80 or at the first control box 78 (test mode).

Beneath these switches 102 and 104, UP and DOWN adjustment buttons 106, 108 are provided. Between these buttons 106 and 108, a STOP button 110 is located. After the ON/OFF switch 100 is turned to the 0N position, one of the four speed selection buttons 92, 94, 96 and 98 can be actuated. The control means 74 will move the pitching machine 12 to the proper angle based on the speed selected. For example, if a 40 mph pitch is selected, the pitching machine 12 will be moved by linear actuator 66 such that baseballs will be released from the pitching machine at a 30° angle. For a 55 mph pitch, the linear actuator 66 will change the angle to approximately 20°. For a 60 mph pitch the angle will be changed to approximately 10° while a 70 mph pitch will have a 4°–5° pitch angle.

Therefore, it should be appreciated that the greater the speed that the balls are thrown from the pitching machine, the less the angle of the pitch will be. In that manner, balls can be consistently thrown to a strike zone. If the 70 mph ball were thrown at a 30° angle, it would cross the plate well above the strike zone. To accommodate the increased speed of the ball, the angle at which the ball is thrown should be adjusted.

While 30°, 20°, 10° and 4°–5° angles have been given, it should be appreciated that these particular angles are merely illustrative. These angles can be set by an owner of the system to a desired position. For example, if there is only a short distance between the pitching machine and the batting cage, then the angle can be appropriately adjusted. Also, if the pitching system is used outside, the pitching machine will likely be mounted about two feet above ground. For indoor use, however, the pitching machine may be four to five feet above ground. To accommodate these differences in the positioning of the pitching machine, the particular angles at which the balls will be thrown can be adjusted.

When selecting a speed for pitching the ball, the angle at which the ball will be thrown is adjusted. This angle will be adjusted to a home position by the control means 74.

Additionally, the control means 74 only permits adjustment of the angles when balls are not being pitched. In other words, if a pitch is begun, the angle at which a ball is thrown cannot be changed. Balls will normally be thrown in a cycle. For example, a customer pays a selected amount of money and then eight balls will be thrown. During this eight ball cycle, the control means 74 will not permit the player to switch the speeds at which balls are thrown. The player will initially make his selection at the second control box 80 to be described in more detail below. After this selection is made, the control means 74 will insure that all balls thrown for that cycle are thrown at the selected speed. In this manner, the player will not be distracted and try to switch speeds during a cycle. The likelihood of injury to the player can therefore be reduced.

In order to accommodate different sized players, the instant invention, however, provides for adjustments to the pitch angle from the home position. Referring to FIG. 5, the second control box 80 provides for a tilt-overriding means 112. Such a tilt-overriding means 112 is also provided at the first control box 78. This tilt-overriding means 112 at the first control box 78 consists of UP adjustment button 106 and DOWN adjustment button 108. These adjustment buttons 106 and 108 will normally be used by the owner or attendant of the system during setup of the system 10. The player (or operator) on the other hand, will normally operate the tilt-overriding means 112 at the second control box 80. This tilt-overriding means 112 at the second control box 80 consists of an UP adjustment button 114 and a DOWN adjustment button 116.

In use, the player will deposit a token or an appropriate amount of money in slot 118. The speed control means 76 consisting of speed selection buttons 120, 122, 124, 126 and 128 will all begin to flash. A user can then select one of these buttons. Once the button is selected, the light for that button will burn solid. In this example, the speed selection buttons 120, 122, 124 and 126 are for 40 mph, 50 mph, 60 mph and 70 mph baseball pitches, respectively. The speed selection button 128 will select softball pitches. For a given cycle (i.e., eight balls), the operator can not change between speeds nor can he or she change between softball and baseball pitches.

As noted above, it should be appreciated that any four different speeds can be selected for the range of speeds or any range of speeds can be used. Moreover, not only can the speeds of the baseball pitches be adjusted, but the speeds for the softball pitches can also be adjusted in a modified pitching system. Any combination of speeds and/or types of pitches is possible with the instant invention.

After the appropriate button 120, 122, 124, 126 or 128 has been selected by the user, the control means 74 will actuate either the baseball pitching machine 12 or the softball pitching machine 14. Also, depending on whether a baseball or softball pitch has been selected, the control means 74 will operate the linear actuator 66 to move the baseball pitching machine 12 if the baseball machine were selected. The baseball pitching machine 12 will be adjusted to the appropriate angle by the linear actuator 66 such that the proper pitch will leave the baseball pitching machine 12. Regardless of the speed of the pitch, this pitch will cross the strike zone.

However, as noted above, different height players can use the instant system 10. These players can use the UP adjustment button 114 or the DOWN adjustment button 116 of the tilt over-riding means 112 on the second control box 80 to slightly move the area where the pitches are thrown. In other words, if a tall player is in a station, then the strike zone needs to rise. On the other hand, if a shorter player is in the station, a lower strike zone is necessary. The control means 74 will normally move the selected baseball pitching machine 12 to an appropriate tilt for a chosen speed such that baseballs will be thrown to a strike zone in the home position. However, if this home position needs to be adjusted due to the height of the player, he or she can select either UP adjustment button 106 or DOWN adjustment button 108. Activation of either button will cause the control means 74 to actuate the linear actuator 66 in order to slightly change the tilt of the baseball pitching machine 12.

As noted above, the first control box 78 also has UP and DOWN adjustment buttons 106 and 108. Therefore, the owner of the system can check that the appropriate UP and DOWN adjustments are being carried out by the baseball pitching machine 12. If there is some problem, the owner can open the first control box 78 and make the appropriate adjustments on the control means.

As a safety feature, when the pitch is begun, the UP and DOWN adjustments can not be changed. The player must wait between pitches to actuate the UP or DOWN adjustment buttons 106, 108.

If an operator uses the tilt-overriding means 112, the angle at which the balls are thrown can be either increased or decreased. Normally, the angle can be incremented upwardly or downwardly from a home position in three steps. Therefore, it is not possible for the user to shoot balls above or below a backstop provided at the station. While three-step increments are contemplated, it should be appreciated that the tilt-overriding means 112 can adjust the height at which baseballs are thrown in a continuous movement within a limited range. Other arrangements are also possible.

After a cycle is completed in the instant system 10, the control means 74 will return the pitching machine 12 to the home position. In other words, after a cycle is completed, a user must deposit additional money or tokens in slot 118. Then the user must select the speed if a baseball is to be thrown or select a softball pitch. If baseballs are to be thrown, depending upon the speed selected, the control means 74 will move the linear actuator 66 to pivot the baseball pitching machine 12 to the appropriate angle for that speed. This angle will be the home position. If a previous user or the same user had actuated the tilt-overriding means 112 in a prior cycle, the control means 74 nonetheless returns the baseball pitching machine 12 to the home position for that speed.

Therefore, if different players successively use the a station, the pitching machine 12 will not be adjusted to an inappropriate height. The pitching machine 12 will throw balls to the strike zone for that speed. If the player need upward or downward adjustment because of their height, then that player can operate the tilt-overriding means 112 for that cycle. At the end of a cycle, any adjustments made by the tilt-overriding means are cancelled and the control means 74 returns the pitching machine 12 to the home position for the next selected baseball speed.

Figure 3:
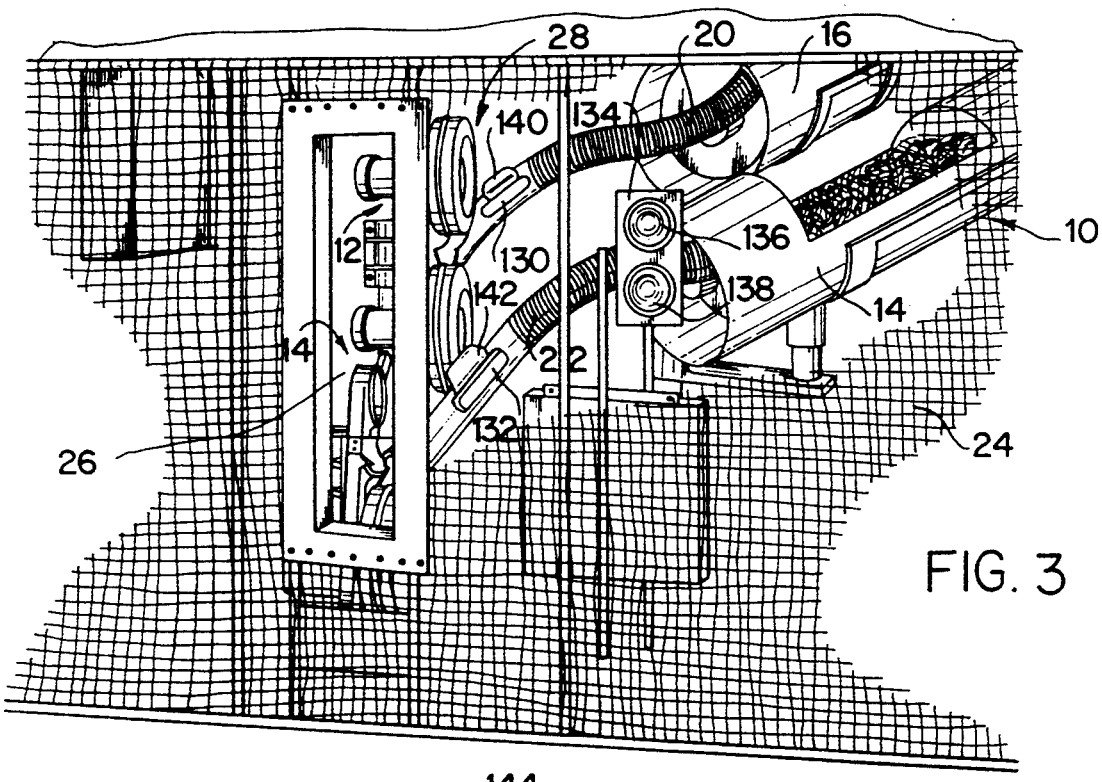
FIG. 3 is a front view of the pitching system of the instant invention.

The view of the pitching machine from the batting station is shown in FIG. 3. As can be seen, both the baseball tube 20 and softball tube 22 have slots 130, 132, respectively. These slots 130, 132 enable the player to see the baseball or softball as it travels down the tube. This visibility helps the player time the pitch and also acts as a safety feature.

Each slot 130, 132 can have a means 140, 142 for illumination, respectively. These means 140 and 142 will ensure that the baseball or softball can readily be seen at night.

A light 134 is provided adjacent the pitching machines 12 and 14. This light 134 has a red signal 136 and a yellow signal 138. When the pitching system 10 has been actuated and balls are about to the thrown, the yellow light 138 will burn. However, when the pitch is made, the light will switch to the red light 136.

As a further safety feature, a buzzer can be provided in order to alert the user when a pitch is coming. The combination of the slots 130, 132, the light 134 and the buzzer ensures that the player knows the pitch is imminent. These features aid the player in determining timing of the pitch. The player is able of anticipating the throw and his or her concentration, swing consistency and timing can be improved.

Figure 4:
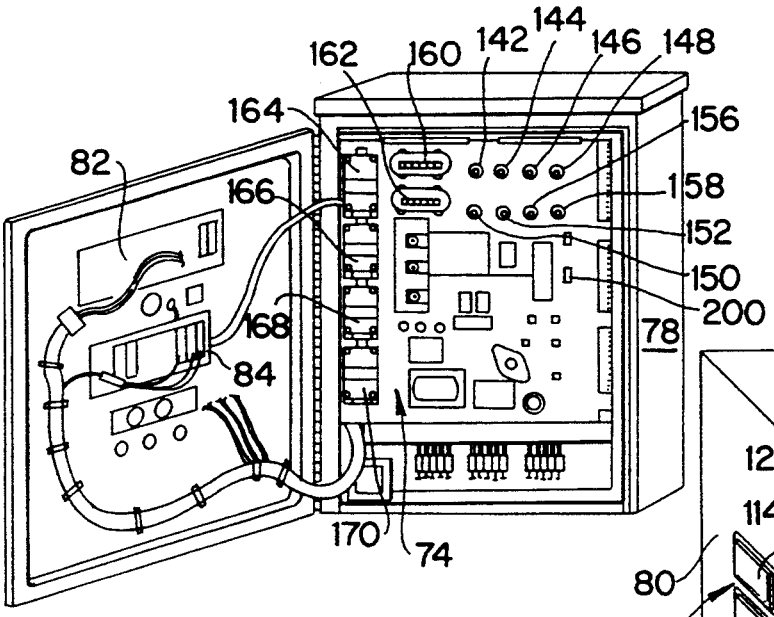
FIG. 4 is a front view of the opened first control box of the instant invention.

In FIG. 4, the interior of the first control box 78 is shown. A series of switches 144, 146, 148 and 150 are provided for changing the attitude of the wheels for the baseball pitching machine 12 and the softball pitching machine 14. Similarly, switches 152, 154, 156 and 158 are provided for adjusting the speeds of each of the wheels of the baseball and softball pitching machines 12 and 14. In this manner, an owner or attendant can adjust the system 10 to his or her requirements.

For example, indoor/outdoor use can be accommodated as well as variations in distance between the pitching machine and batting stations at different facilities. These switches 144–158 can be utilized in order to selected the speeds at which the balls are thrown from either pitching machine 12 or 14. Also, the amount of tilt provided by the linear actuator 66 can be adjusted by the owner or attendant. Therefore, it can be ensured that the balls will to be thrown to the proper strike zone.

Within the first control box 78 are mechanical counters 160 and 162. Counter 162 will count the number of pitches thrown by the system while counter 162 will count the number of tokens for the system. To adjust the number of pitches per cycle for the amount of money or tokens used and to change the amount of money/tokens to energize a cycle, dip switch 200 can be used. The first control box 78 can be locked by the owner. Therefore, attendants cannot change the speed, angle or count for the number of pitches unless they have access to the locked control box 78.

Also, the first control box 78 has controls 164 and 166 for the motors for driving the baseball and softball wheels and controls 168 and 170 for feeding the baseballs or softballs from the hopper. While a particular hardwired configuration has been shown within the first control box 78, it should be appreciated that one skilled in the art can accomplish the control by any known arrangement. For example, computer software control or other hardwiring configurations can be used.

The control means 74 will ensure that the lower wheel 34 and 38 of the first and second set of wheels 28, 30 moves faster than the upper wheels 32, 36. In that manner, balls having backspin will be thrown by either pitching machine 12 or 14. The control means 74 can also be actuated to throw the ball with backspin or with overspin such that a high arc slow pitch is accomplished. To throw high arc slow pitches, the speed of either the lower wheel 34 or 36 will be greatly increased compared to the speed of the upper wheel 32, 36. This will put an overspin on the ball.

The control means 74 will regulate voltage going to the two separate motors 40 and 42 or the two separate motors 44 and 46. In this manner, the appropriate amount of backspin can be placed on the ball due to the speed of rotation of wheels 32, 34 or wheels 36, 38. The speed of rotation for the upper wheels 32, 36 will be set to a lower rpm so as to ensure that the proper backspin is placed on the ball. If the control means 74 is actuated to throw a high arc slow pitch, then the speed of the lower rollers 34 and 38 will be increased. The ratio of speeds between the upper and lower wheels is automatically controlled by the control means 74. Irrespective of the ball thrown, proper backspin can be maintained on the ball to create an accurate pitch.

The instant pitching system can be customized to the location where it is to be used. Therefore, it is adaptable for indoor/outdoor use and for different sized batting areas. The instant system is also inexpensive and easy to maintain.

Depending upon whether a baseball or softball is selected by the user, either the first set of wheels 28 or second set of wheels 30 will rotate. If the first set of wheels 28 is selected such that baseballs are pitched by machine 12, the second set of wheels 30 will not rotate. Alternatively, if softballs are pitched by the second set of wheels 30, then the wheels 28 of the baseball pitching machine 12 will be stationary.

After a cycle is completed (for example, eight balls have been pitched) both sets of wheels 28 and 30 will stop five minutes after initial activation unless a user reactivates the system by depositing additional tokens in slot 118 and selecting one of the speed control means 76. Alternatively, if the owner or attendant operates the speed control means 76 at the first control box 78, then the wheels will continue to rotate. By continuing rotation of the wheels for a predetermined time, for example five minutes, the selected pitching machine 12 or 14 will start the pitching cycle more quickly since there is no static friction to overcome as the machine gets up to speed. This speeds play during busy times. Otherwise, the system goes into a standby mode and the rotation of the wheels will stop after five minutes to conserve energy and prevent unnecessary wear on the pitching machines 12 and 14.

By providing the displays 82 and 84, the owner or attendant can know exactly at what speed the baseballs or softballs are thrown. The switches 120, 122, 124 and 126 at the second control box 80, can have indicia 172 applied thereon. These indicia will indicate whether a softball or baseball is selected and what the speed of the baseball pitch will be. The player is then able to determine exactly at what speeds they are hitting the baseballs. If the system only indicated level 1, level 2, etc., then it is difficult for a player to go between different locations and compare their batting practice. Because the player is able to determine the exact speed at which balls are thrown, it is an easy matter to compare a practice between different batting stations and between different systems at different locations. Also, with the current availability of radar guns, young players and their coaches know the speed at which pitchers their age can throw the ball. Thus, to prevent over-training or under-training, the proper speed can be chosen for the age and ability of the batter.

When a player enters a batting station, he or she can deposit a coin or token in slot 118. All lights 120, 122, 124, 126 and 128 will flash. When the player selects one of these buttons, that light will burn solid. If button 128 is selected, then softballs are thrown. On the other hand, if buttons 120, 122, 124 or 126 are selected, then baseballs at a desired speed will be selected. If necessary, the player can adjust the strike zone upwardly or downwardly by operating switches 114 and 116 of the tilt-overriding means 112.

After these selections have been made, softballs or baseballs will be released from the respective hopper 16 or 18. For a given cycle, only baseballs at a selected speed or softballs will be thrown. If the player had selected a baseball at a particular speed, the control means 74 will actuate the linear actuator 66 to pivot the baseball pitching machine 12 to the appropriate angle. Baseballs can then be thrown to the strike zone for the selected speed. When the baseballs are released from hopper 16, they will travel down tube 20. The player can view the baseballs through slot 130. Also, the light 134 and buzzer will notify the player that the pitch has begun. Baseballs will then be thrown by the first set of wheels 28 of the baseball pitching machine 12. The baseballs will exit the pitching machine and travel through opening 26 in netting 24.

For a given cycle (eight balls, for example) the baseballs will be thrown at the same speed. During the next cycle, a player can again deposit a coin or token in slot 118 and select any appropriate speed. If the player selects a different baseball pitch speed, the control means 74 will move the pitching machine 12 by actuating the linear actuator 66. Therefore, the appropriate angle for the new speed can be selected. While the linear actuator 66 is moving the baseball pitching machine 12, the control means 74 will prevent any pitches. Therefore, errant pitches are avoided.

Of course, if the tilt-overriding means 112 has been activated by a user, the user must again activate either the UP adjustment button 114 or the DOWN adjustment button 116 between cycles. This is because the control means 74 will return the baseball pitching machine 12 to the home position between cycles. While the user is operating the tilt-overriding means 112 to adjust the angle of pitch for their particular height, the control means 74 will prevent pitching of baseballs. Therefore, a user operating buttons 114 or 116 will not be unexpectedly hit by a thrown ball.

The method of the instant invention involves providing a pitching machine 12 or 14 with two rotatable wheels 32, 34 or 36, 38. These wheels will be rotated in opposite directions. A speed for throwing the balls can then be selected by a user. The balls will be sequentially fed from either hopper 16 or 18 to the wheels. The balls are thrown by the wheel at a selected angle. If the speed at which the balls are to be thrown changes between cycles, the control means 74 will change the angles at which the balls are thrown. As the speed increases for the pitched balls, the angle at which they are thrown will decrease.

In the instant pitching system, a plurality pitching machines can be used in different stations. Instead of having control means 74 for each station, it is contemplated that a single control means can be used.

Either softballs or baseballs can be thrown to a single station by this system 10. Moreover, different speed baseballs and/or softballs can be thrown with the instant invention. Therefore, the number of players who will use a station is not limited. The instant system 10 automatically adjusts for the angle at which the baseball is thrown. Therefore, the operator does not need to change this angle between different speeds and/or different users. In order to accommodate different heights of the users, the tilt-overriding means 112 can be used. Therefore, this pitching system 10 is very user friendly.

While the foregoing description has described a pitching system for baseballs or softballs, it should be appreciated that this system is applicable to any number of sports. Speeds at which balls are thrown in the instant systems can vary between Little Leaguer speeds to those that will challenge any professional. Changes can quickly and easily be carried out for any number of required machines in this system. Moreover, the player will have a clear indication of what speed at which they're hitting the ball. This will allow the players to train at a specific skill level.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A pitching system comprising:

a pitching machine:

means for sequentially feeding balls to the pitching machine which throws the balls therefrom;

at least one motor for driving the pitching machine;

tilting means for tilting the pitching machine to adjust an angle from which the balls are thrown from the pitching machine, the angle being measured from a generally horizontal plane;

speed control means for adjusting a speed at which the pitching machine throws the balls; and control means for controlling the tilting means and speed control means to coordinate throwing of the balls from the pitching machine, the control means automatically controlling the tilting means to decrease the angle in response to the speed control means increasing the speed at which the pitching machine throws the balls.

2. The pitching system as recited in claim 1, wherein the pitching machine has a rotatable upper wheel and a rotatable lower wheel, the means for sequentially feeding balls feeds balls to the wheels, the balls passing between the wheels and being thrown therefrom, the at least one motor simultaneously driving at least one of the upper and lower wheels.

3. The pitching system as recited in claim 2, wherein two pitching machines are provided, each pitching machine having a set of upper and lower wheels, the tilting means controlling at least one set of the two sets of upper and lower wheels to change the angle at which the balls are thrown from the wheels.

4. The pitching system as recited in claim 3, wherein the two sets of wheels comprise a first set for throwing baseballs and a second set for throwing softballs, the two sets being located one above another.

5. The pitching system as recited in claim 4, wherein each set of wheels has at least one motor connected thereto, the first set of wheels being located above the second set of wheels and the tilting means being connected to the first set of wheels, the speed control means controlling speed of the second set of wheels to be a first speed for throwing softballs and controlling the first set of wheels to be one of four operator-selected speeds.

6. The pitching system as recited in claim 5, wherein the speed control means includes five buttons whereby the operator can select one of four speeds for throwing baseballs or one speed for throwing softballs, the control means controlling the motors to rotate the upper wheel slower than the lower wheel in at least one selected set of the sets of wheels, a ratio of speed between the upper wheel and the lower wheel of the at least one selected set being variable for the at least one selected set to throw the balls with a back spin or an overspin, a high arc slow pitch being thrown when the balls are thrown with an overspin.

7. The pitching system as recited in claim 5, wherein the means for feeding comprises a hopper and tube for each of the pitching machines, the tubes connecting the hoppers to the set of wheels for a respective pitching machine and each tube having a slot therein through which balls are visible before the balls are thrown by the set of wheels, the pitching system further comprising means for illuminating each of the slots in the tubes.

8. The pitching system as recited in claim 2, wherein the speed control means controls the at least one motor to rotate the upper wheel slower than the lower wheel, a ratio of speed between the upper wheel and the lower wheel being variable by the control means for the at least one set of wheels to throw the balls with a back spin or an overspin, the at least one set of wheels throwing a high arc slow pitch when the balls are thrown with an overspin.

9. The pitching system as recited in claim 2, further comprising a post and collar, the pitching machine being mounted on the post by the collar at a pivot point, the tilting means comprising a linear actuator mounted between the collar and the pitching machine, the linear actuator pivoting the pitching machine about the pivot point to change the angle from which the balls are thrown from the wheels.

10. The pitching system as recited in claim 9, wherein the upper wheel is rotatable about a first axis, the lower wheel is rotatable about a second axis and the pitching machine is pivotable about a third axis, the third axis passes through the pivot point and the first, second and third axes being generally parallel and noncoincident.

11. The pitching system as recited in claim 2, wherein the at least one motor rotates the wheels for a predetermined period of time after a cycle of balls have been thrown whereafter the control means terminates rotation of the wheels unless the system is reactivated.

12. The pitching system as recited in claim 1, wherein the means for feeding comprises a hopper and tube, the tube connecting the hopper to the pitching machine and having a slot therein through which balls are visible before the balls are thrown by the pitching machine.

13. The pitching system as recited in claim 12, further comprising means for illuminating the slot.

14. The pitching system as recited in claim 1, further comprising a display for indicating the speed at which the balls are thrown from the pitching machine, the display being operatively connected to the control means.

15. The pitching system as recited in claim 1, wherein the control means comprises first and second control boxes, the first control box being located in the vicinity of the pitching machine and the second control box being located at a remote location from the pitching machine, the speed control means being located on both the first and second control boxes, both of the control boxes being connected to the pitching machine.

16. The pitching system as recited in claim 15, further comprising tilt over-riding means for changing the angle from which the balls are thrown from the pitching machine, the tilting means moving the pitching machine to a home position in response to a signal from the control means, the signal being based on the speed selected through the speed control means, the tilt over-riding means adjusting the angle of the pitching machine from the home position, the tilt over-riding means being operator controlled and being located on both the first and second control boxes.

17. The pitching system as recited in claim 1, further comprising tilt over-riding means for changing the angle from which the balls are thrown from the pitching machine, the tilting means moving the pitching machine to a home position in response to a signal from the control means, the signal being based on the speed selected through the speed control means, the tilt over-riding means adjusting the angle of the pitching machine from the home position, the tilt over-riding means being operator controlled and being connected to the control means.

18. The pitching system as recited in claim 1, wherein the operator selects one of four speeds through the speed control means for each cycle of operation of the pitching system, the control means emitting a signal to the tilting means in response to the selected speed for the tilting means to change the angle of the pitching machine, the tilting means moving the pitching machine to one of four angles in response to the signal which is based on the speed selected, the angle being decreased as the speed increases.

19. The pitching system as recited in claim 18, further comprising two pitching machines, the first pitching machine having a first set of wheels for throwing baseballs and the second pitching machine having a second set of wheels for throwing softballs, the operator selects one of the pitching machines through the speed control means for each cycle of operation of the pitching system, the tilting means being connected to the first pitching machine.

20. A method for pitching a ball comprising the following steps:

providing a pitching machine;

selecting a speed for throwing balls from the pitching machine;

sequentially feeding balls to the pitching machine;

throwing balls from the pitching machine, the balls being thrown at a selected angle;

selectively changing speed at which balls are thrown by the pitching machine; and automatically changing the angle at which the balls are thrown in response to the changing of the speed at which balls are thrown, the angle being based on the selected speed, the angle decreases as the speed increases.

21. The method for pitching as recited in claim 20, further comprising the steps of;

providing two rotatable wheels in the pitching machine; and rotating each of the wheels in opposite directions, the step of sequentially feeding feeds the balls to the wheels, the step of throwing throws the balls from the wheels and the step of selectively changing speed changes speed of rotation of the wheels.

22. The method for pitching as recited in claim 21, further comprising the following steps:

providing a second pitching machine in addition to a first pitching machine, both pitching machines having two rotatable wheels;

selecting one of the two pitching machines;

rotating the wheels of only the selected pitching machine;

sequentially feeding baseballs to the first pitching machine when the first pitching machine is selected;

sequentially feeding softballs to the second pitching machine when the second pitching machine is selected;

throwing baseballs from the first pitching machine when the first pitching machine is selected and baseballs are feed thereto;

throwing softballs from the second pitching machine when the second pitching machine is selected and softballs are feed thereto; and selectively changing the speed of rotation of the wheels of the first pitching machine, the step of changing the angle only changing the angle at which the baseballs are thrown from the first pitching machine when the speed of rotation of the wheels of the first pitching machine is changed.

23. The method for pitching as recited in claim 20, wherein the step of changing comprises tilting the pitching machine to one of a plurality of home positions, the home positions being based on the selected speed, the tilting of the pitching machine changing the angle at which the balls are thrown, the method further comprising the following steps:

selectively adjusting the angle at which the balls are thrown after the pitching machine moves to a selected home position whereby height of an operator is accommodated, the selective adjustment being chosen by the operator; and displaying the speed at which the balls are thrown by the pitching machine.

* * * * *